US005313719A

United States Patent [19]

Koethe

[11] Patent Number: 5,313,719

[45] Date of Patent: May 24, 1994

[54] SHOE SHIELD

[76] Inventor: Terence L. Koethe, 1021 Oakwood Dr., Keller, Tex. 76248-4002

[21] Appl. No.: 53,956

[22] Filed: Apr. 27, 1993

Related U.S. Application Data

[63] Continuation of Ser. No. 641,605, Jan. 15, 1991, abandoned.

[51] Int. Cl.[5] ..... A43B 5/00; A43C 13/14

[52] U.S. Cl. ..... 36/72 R; 36/136; 36/71.5

[58] Field of Search ..... 36/1, 70 R, 71.5, 72 R, 36/72 A, 132, 133, 136

[56] References Cited

U.S. PATENT DOCUMENTS

| | | | |
|---|---|---|---|
| 283,556 | 4/1985 | Campbell | 36/113 |
| 291,621 | 9/1987 | Herman | 36/72 R |
| 690,003 | 12/1901 | Altman . | |
| 1,043,888 | 11/1912 | Wilson . | |
| 1,171,582 | 2/1916 | Bertona . | |
| 1,640,665 | 8/1927 | Muscenta . | |
| 1,660,664 | 2/1928 | Aleksandrowicz . | |
| 2,022,554 | 11/1933 | Williams . | |
| 2,871,537 | 3/1959 | Hickerson . | |
| 3,006,086 | 3/1960 | Bird . | |
| 3,473,198 | 10/1969 | Meier . | |
| 3,518,781 | 7/1970 | De Vita . | |
| 3,525,165 | 8/1970 | Randall, Jr. . | |
| 3,564,736 | 2/1971 | Cunningham . | |
| 4,065,861 | 1/1978 | Pelfrey . | |
| 4,333,248 | 6/1982 | Samuels | 36/72 R |
| 4,507,882 | 4/1985 | Harrell | 36/114 |
| 4,536,975 | 8/1985 | Harrell | 36/136 |
| 4,571,854 | 2/1985 | Edens | 36/50.1 |
| 4,597,198 | 7/1986 | Schweitzer | 36/100 |
| 4,766,682 | 8/1988 | Malloy, III | 36/130 |
| 4,967,493 | 11/1990 | Mues | 36/72 R |
| 4,991,318 | 2/1991 | Cornell | 36/72 R |
| 5,063,690 | 11/1991 | Slenker | 36/136 |

*Primary Examiner*—Paul T. Sewell
*Assistant Examiner*—Marie Denise Patterson

[57] ABSTRACT

A shoe shield is adapted to be detachably secured to the lacings of a shoe to protect the lacings and to provide a surface for a decorative emblem or feature.

5 Claims, 2 Drawing Sheets

FIG.4
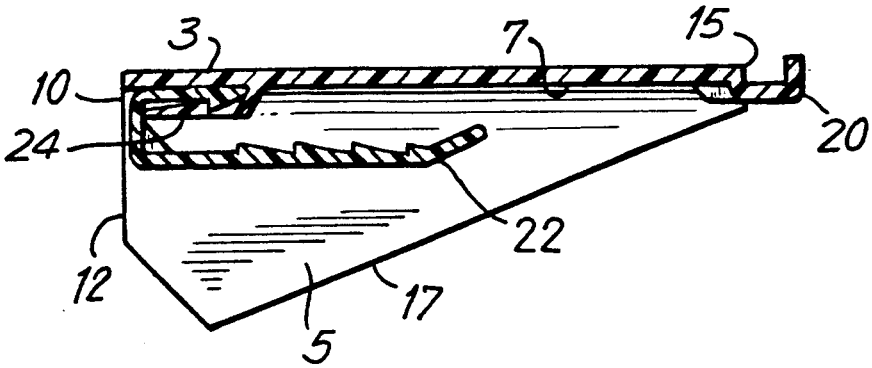
FIG.5
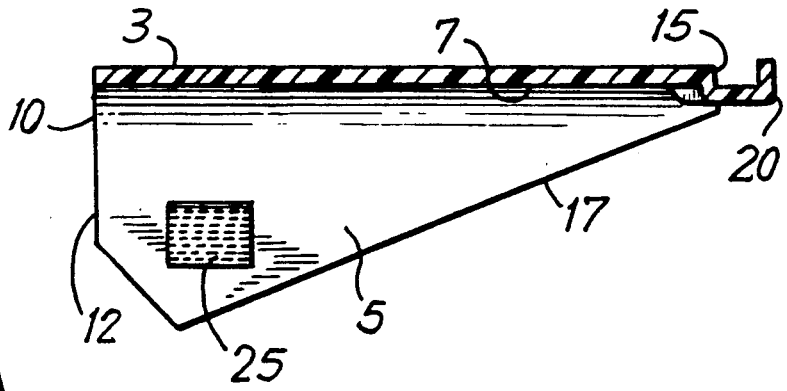
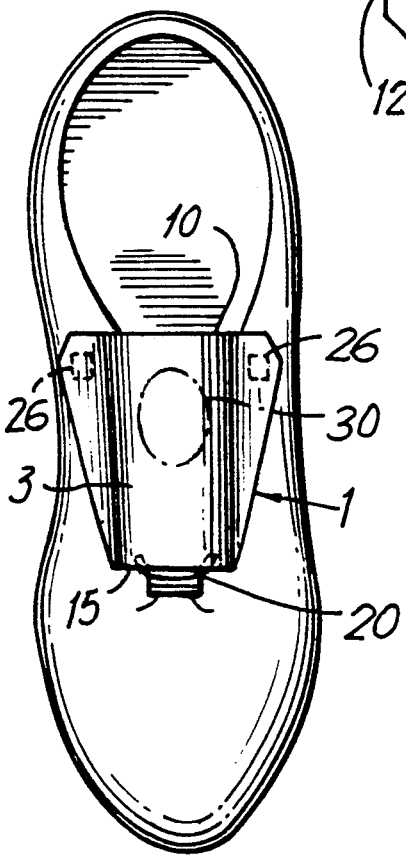
FIG.6

SHOE SHIELD

This application is a continuation of application Ser. No. 07/641,605, filed Jan. 15, 1991 now abandoned.

BACKGROUND OF THE INVENTION

1. Field of the Invention

The present invention relates generally to shoe guards and, more particularly, to a decorative shield that is readily detachable from the shoe and completely covers the shoelaces to provide a contemporary and stylish appearance.

2. Description of the Background

Shoe guards generally are desirable to prevent shoelaces from untying. Recently, it has become increasingly popular to wear and display insignia, cartoon characters, words and phrases on various articles of clothing, particularly on shoes. At the same time, it is desirable for shoe designs, particularly sneakers, to be contemporary and stylish. To this end, several shoe guard designs previously have been proposed.

U.S. Pat. No. 4,766,682 (Malloy) proposes a shoe lace cover strap that wraps around the instep of a shoe. The ends of the strap connect on the upper portion of the shoe laces by hook and loop fasteners. The shoe lace cover strap is adapted to display an emblem.

U.S. Pat. No. 4,571,854 (Edens) proposes a device for preventing shoe laces from untying. The proposed device includes a band having a recess through which the shoelace is threaded. Thus, a lower portion of the band rests on the shoe underneath the laces, while an upper portion of the band folds over the laces and connects to the lower portion by hook and loop fasteners. The band also is adapted to display an ornamental design.

U.S. Pat. No. 4,065,861 (Pelfrey) proposes a shoelace cover that is fixed to one side of the shoe and folds over only a part of the shoelaces, attaching to the other side of the shoe by hook and loop fasteners. See also U.S. Pat. Nos. 1,660,664 (Aleksandrowicz) and Des. 283,556 (Campbell) for prior proposals where a shoe guard is sewn to the shoe.

Although capable of preventing shoelaces from untying, the above-proposed shoelace covers do not quickly and easily detach from the shoe and do not completely cover the shoelaces thus detracting from the contemporary shoe styling that currently is popular.

SUMMARY OF THE INVENTION

It is an object of the present invention to provide a decorative utility shield for shoes that prevents the shoelaces from untying.

It is another object of the present invention to provide a decorative utility shield with at least one end that is readily detachable from a shoe.

It is a further object of the present invention to provide a decorative utility shield that completely covers the shoe laces to create a contemporary, uninterrupted and stylish appearance.

It is also an object of the present invention to create a more aerodynamic look and structure over the lace area of a shoe.

According to an aspect of the present invention, a decorative utility shield comprises a substantially channel-shaped thermoplastic shell. The utility shield also comprises a tab extending from the front end of the shield for securing the utility shield to the frontmost fold of the shoelace, and fastening means attached to the inner surface of the shell for further securing the utility shield to the shoe.

The above and other objects, features, and advantages of the present invention will become apparent from the following detailed description of preferred embodiments when read in conjunction with the accompanying drawings, in which the same reference numerals are used to identify the same or similar parts in the several views.

BRIEF DESCRIPTION OF THE DRAWINGS

FIG. 4 is a cross-sectional view of the utility shield of FIG. 2 taken along line IV—IV.

FIG. 5 is a cross-sectional view of the utility shield of FIG. 2 taken along line IV—IV according to another embodiment of the present invention.

FIG. 6 is a top plan view of a utility shield attached to a shoe according to an embodiment of the present invention.

DETAILED DESCRIPTION OF PREFERRED EMBODIMENTS

Figure 1:
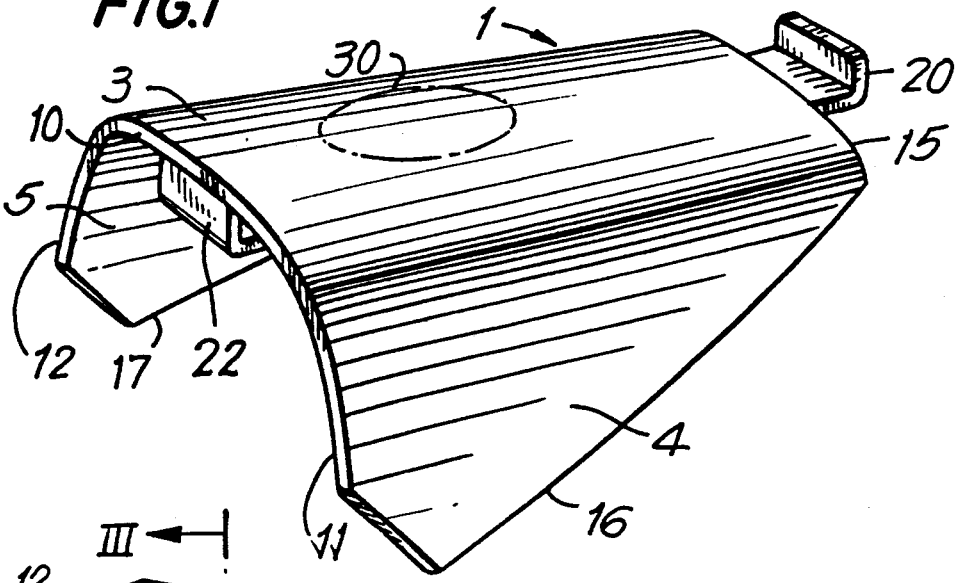
FIG. 1 is a perspective view of a utility shield according to an embodiment of the present invention.
Figure 3:
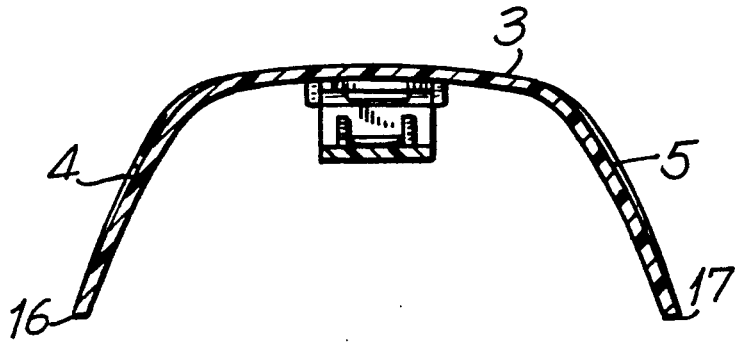
FIG. 3 is a cross-sectional view of the utility shield of FIG. 2 taken along line III—III.

With reference to the drawings, a utility shield 1 according to an embodiment of the present invention is formed of a thermoplastic shell which is molded to form a substantially channel-shape, as shown in FIGS. 1 and 3. The shield, comprising the upper guard, two side legs, forward tab, and, for the embodiment containing it, the elongated clip, is preferably composed of one piece of material. A rectangular, substantially planar upper guard 3 forms the center section of the channel, and two substantially triangular-shaped side legs 4, 5 form the outer sections of the channel. The upper guard 3 has a forward edge 15 and a rear edge 10. The legs 4, 5 have respective rear edges 11, 12 and respective side edges 16, 17. The length 1 of the utility shield from forward edge 15 to rear edge 10 is such as to substantially cover the laces of the shoe.

Due to the substantially triangular shape of the legs 4, 5, the distance between the upper guard 3 and the side edges 16, 17 increases from forward to rear, causing the utility shield 1 to have a greater height at the rearward edge 10 than at the forward edge 15. This configuration enables the utility shield to conform to and rest upon the upper portion of a shoe.

Figure 2:
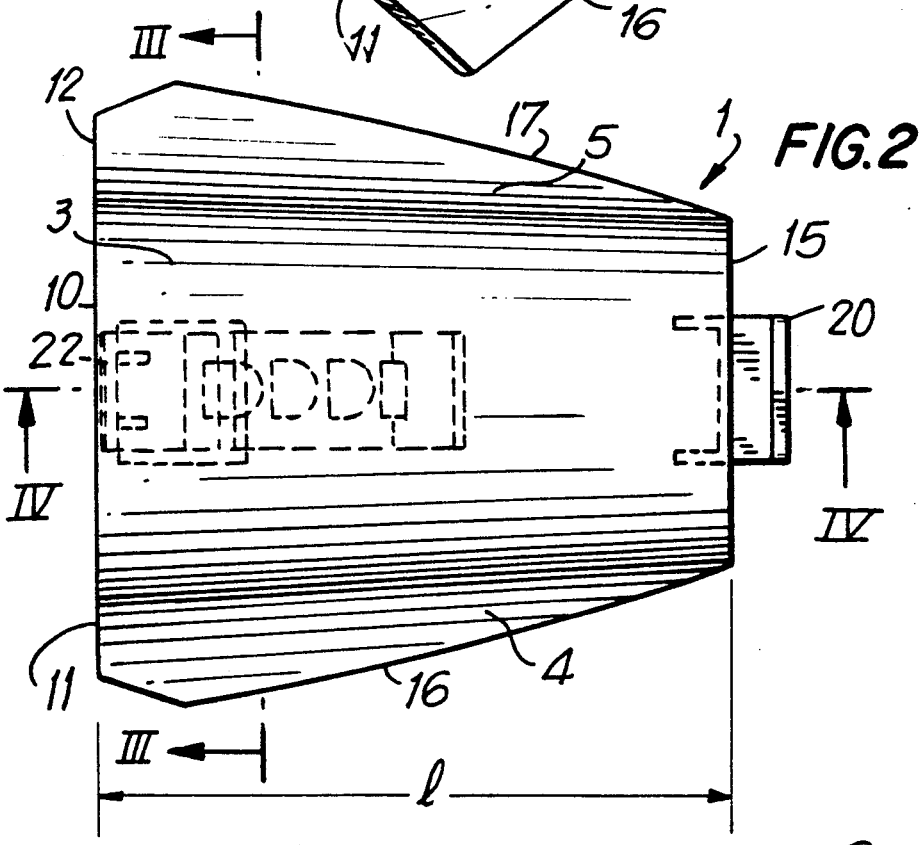
FIG. 2 is a top plan view of a utility shield according to an embodiment of the present invention.

A tab 20 formed on the utility shield 1 extends outward from the forward edge 15 of the upper guard 3, as shown in FIGS. 1 and 2. The tab 20 is adapted to attach to the frontmost fold of the shoelace to secure the front portion of the utility shield to the shoe.

A fastener is attached to the bottom surface 7 of the upper guard 3 to also detachably secure the rear portion of the utility shield to the shoe.

According to a first embodiment, as shown in FIG. 4, the fastener includes an elongated clip 22 extending substantially parallel to bottom surface 7 from rear edge 10 toward forward edge 15. The clip 22 is connected to the bottom surface 7 at rear edge 10 by a flexible interlocking groove connecting device 24. This inner surface of the clip 22 is provided with a series of parallel grooves to securely attach to the shoe laces.

According to a second embodiment of the present invention, as shown in FIG. 5, hook and loop fasteners secure the rear portion of the utility shield to the shoe. Hook and loop fasteners 25, such as these sold under the trademark Velcro, are placed at selected locations on the inner surfaces of the legs 4, 5. Desirably, one of such hook and loop fasteners 25 is attached to leg 5 near the intersection of edges 17 and 12. A corresponding hook and loop fastener 26 is attached to the shoe at a location corresponding to the fastener 25 so as to secure the utility shield to the shoe when the fastener elements 25 and 26 are engaged, as shown in phantom in FIG. 6.

The outer surface of the upper guard 3 is adapted to display an emblem or decorative feature 30, as illustrated in FIGS. 1 and 6. It also is contemplated that an advertising message may be carried on the upper guard.

In use, utility shield 3 is centered over the laces of a shoe, substantially covering the shoelaces. The forward edge 15 faces the toe of the shoe, and the rear edge 10 faces the heel of the shoe. In the first embodiment, clip 22 is slipped between the shoelaces and the tongue of the shoe. In the second embodiment, hook and loop fastener elements 25 and 26 are pressed together. Tab 20 is positioned underneath the front lace of the shoe, which generally extends horizontally across the forwardmost eyes of the shoe. FIG. 6 illustrates a utility shield properly secured to a shoe in accordance with the present invention.

Any variations or modifications of the present invention envisioned by one of ordinary skill in the art are contemplated to be within the scope of this invention.

I claim:

1. A utility shield for a laced shoe comprising:

an upper guard portion for covering substantially the entire lacings of the shoe including the knottable rear end lace portion thereof;

first and second substantially identical leg portions extending from opposing longitudinal side edges of said upper guard portion, a substantially channel-shaped shell, having inner and outer surfaces, for extending vertically downwardly along a substantial portion of the sides of the upper of the shoe, to a region above the sole, and for covering that portion of the laces and lacing holes of the shoe not covered by the upper guard portion;

first and second fastening means located at the front and rear of the utility shield, respectively, for connecting the utility shield and shoe and at least one of said fastening means releasably connecting the utility shield and shoe for access to the shielded portion of the shoe;

the first fastening means comprising a tab extending from the front of the upper guard portion, said tab comprising a member having a body portion extending generally parallel to the upper guard and having a channel therein and a leg portion extending upwardly from the front end of the body portion, whereby the frontmost loop of the shoe lace may be positioned in the channel when the tab is inserted under the frontmost lace loop; said tab being disengageable from the frontmost lace loop by lifting said lace loop and rearwardly pulling said utility shield;

the second fastening means comprises an elongated clip extending from the rear of the utility shield upper guard portion downward and extending substantially parallel to said inner surface of said guard whereby said clip may be longitudinally slid between the shoelace folds and the tongue of the shoe by being longitudinally inserted under the rear portion of the lace structure, and being easily detachable by rearwardly pulling said utility shield, once the first fastening means is detached, the second fastening means being hidden from view when the utility shield is in place on the shoe.

2. A utility shield according to claim 1, wherein said first and second side leg portions are substantially triangular in shape, whereby the height of the utility shield increases from the forward edge to the rearward edge.

3. A utility shield according to claim 1, further comprising light-transferring material on the outer surface of the upper guard portion.

4. A utility shield according to claim 1, further comprising an emblem, design or decorative indicia formed on the upper guard portion.

5. A utility shield according to claim 1, wherein the utility shield is formed of one piece of thermoplastic material.

* * * * *